US008313593B2

(12) United States Patent
Hawk et al.

(10) Patent No.: US 8,313,593 B2
(45) Date of Patent: Nov. 20, 2012

(54) METHOD OF HEAT TREATING A NI-BASED SUPERALLOY ARTICLE AND ARTICLE MADE THEREBY

(75) Inventors: Jeffrey Allen Hawk, Corvallis, OR (US); Robin Carl Schwant, Pattersonville, NY (US)

(73) Assignee: General Electric Company, Schenectady, NY (US)

( * ) Notice: Subject to any disclaimer, the term of this patent is extended or adjusted under 35 U.S.C. 154(b) by 483 days.

(21) Appl. No.: 12/559,626

(22) Filed: Sep. 15, 2009

(65) Prior Publication Data

US 2011/0061394 A1 Mar. 17, 2011

(51) Int. Cl.

| | |
|---|---|
| ***C22F 1/10*** | (2006.01) |
| ***F02C 7/00*** | (2006.01) |
| ***C22C 19/05*** | (2006.01) |
| ***F01D 5/28*** | (2006.01) |

(52) U.S. Cl. ..... 148/675; 60/752; 148/427; 415/200; 416/241 R

(58) Field of Classification Search ..... 420/451; 148/410, 675, 427; 60/752; 415/200; 416/241 R
See application file for complete search history.

(56) References Cited

U.S. PATENT DOCUMENTS

| | | | | |
|---|---|---|---|---|
| 3,046,108 | A | 7/1962 | Eiselstein | |
| 3,160,500 | A | 12/1964 | Eiselstein et al. | |
| 3,420,660 | A | 1/1969 | Kawahata et al. | |
| 3,826,649 | A | 7/1974 | Soderberg et al. | |
| 3,871,928 | A | 3/1975 | Smith, Jr. et al. | |
| 3,972,752 | A | 8/1976 | Honnorat et al. | |
| 4,388,124 | A | 6/1983 | Henry | |
| 4,400,210 | A | 8/1983 | Kudo et al. | |
| 4,400,211 | A | 8/1983 | Kudo et al. | |
| 4,608,094 | A * | 8/1986 | Miller et al. | 148/677 |
| 4,652,315 | A | 3/1987 | Igarashi et al. | |
| 4,750,950 | A | 6/1988 | Clatworthy et al. | |

(Continued)

FOREIGN PATENT DOCUMENTS

EP 0247577 A1 12/1987

(Continued)

OTHER PUBLICATIONS

Karl A. Heck, "The Time-Temperature-Transformation Behavior of Alloy 706", The Minerals, Metals & Materials Society, 1994, pp. 393-404.

(Continued)

*Primary Examiner* — Jessee R. Roe
(74) *Attorney, Agent, or Firm* — Cantor Colburn LLP

(57) ABSTRACT

A method of heat treating an Ni-base superalloy article is disclosed. The method includes hot-working an article comprising an NiCrMoNbTi superalloy comprising, in weight percent, at least about 55 Ni to produce a hot-worked microstructure; solution treating the article at a temperature of about 1600° F. to about 1750° F. for about 1 to about 12 hours to form a partially recrystallized warm-worked microstructure; and cooling the article. The method also includes precipitation aging the article at a first precipitation aging temperature of about 1300° F. to about 1400° F. for a first duration of about 4 hours to about 12 hours; cooling the article to a second precipitation aging temperature; precipitation aging the article at a second precipitation aging temperature of about 1150° F. to about 1200° F. for a second duration of about 4 hours to about 12 hours; and cooling the article from the second precipitation aging temperature to an ambient temperature.

6 Claims, 19 Drawing Sheets

U.S. PATENT DOCUMENTS

| | | | |
|---|---|---|---|
| 4,788,036 | A | 11/1988 | Eiselstein et al. |
| 4,894,089 | A | 1/1990 | Henry |
| 4,979,995 | A | 12/1990 | Hattori et al. |
| 4,983,233 | A | 1/1991 | Henry |
| 5,059,257 | A | 10/1991 | Wanner et al. |
| 5,124,123 | A | 6/1992 | Henry |
| 5,129,968 | A | 7/1992 | Henry |
| 5,129,970 | A | 7/1992 | Henry |
| 5,129,971 | A | 7/1992 | Henry |
| 5,130,086 | A | 7/1992 | Henry |
| 5,130,087 | A | 7/1992 | Henry |
| 5,130,088 | A | 7/1992 | Henry |
| 5,130,089 | A | 7/1992 | Henry |
| 5,156,808 | A | 10/1992 | Henry |
| 5,415,712 | A | 5/1995 | Thamboo |
| 5,529,643 | A | 6/1996 | Yoon et al. |
| 5,547,523 | A | 8/1996 | Blankenship, Jr. et al. |
| 5,556,484 | A | 9/1996 | Blankenship, Jr. et al. |
| 5,556,594 | A | 9/1996 | Frank et al. |
| 5,593,519 | A | 1/1997 | Blankenship, Jr. et al. |
| 5,846,353 | A | 12/1998 | Nazmy et al. |
| 5,863,494 | A | 1/1999 | Nazmy et al. |
| 6,146,478 | A | 11/2000 | Balbach et al. |
| 6,315,846 | B1 | 11/2001 | Hibner et al. |
| 6,531,002 | B1 | 3/2003 | Henry et al. |
| 7,033,448 | B2 * | 4/2006 | Groh et al. ..... 148/677 |
| RE40,501 | E | 9/2008 | Henry et al. |
| 2010/0276041 | A1 | 11/2010 | Yang et al. |

FOREIGN PATENT DOCUMENTS

| | | | |
|---|---|---|---|
| EP | 0774526 | A1 | 11/1996 |
| EP | 0774530 | A1 | 11/1996 |
| EP | 0839923 | A1 | 10/1997 |
| WO | 00/03053 | A1 | 1/2000 |

OTHER PUBLICATIONS

Sarwan Mannan and Frank Veltry, "Time-Temperature-Transformation Diagram of Alloy 725", The Minerals, Metals & Materials Society, 2001, pp. 345-350.

* cited by examiner

FIG. 7

Alloy A Master Chemistry and DoE1 Element Levels

| Element | Nominal Chemistry | DoE1 Low | DoE1 High |
|---|---|---|---|
| Al | 0.25 | 0.10 | 0.50 |
| B | 0.0015 | | |
| C | 0.01 | 0.01 | 0.05 |
| Co | | | |
| Cr | 21.50 | 20.00 | 23.00 |
| Fe | 8.00 | 7.50 | 8.50 |
| Mo | 8.00 | 7.40 | 8.60 |
| Nb | 3.40 | 3.10 | 3.70 |
| Ni | 57.30 | | |
| Ta | | | |
| Ti | 1.50 | 1.00 | 1.80 |
| Si | 0.15 max | 0.07 | 0.20 |
| Mg | 0.005 | | |
| Mn | 0.15 max | | |

FIG. 8

DoE1 Alloy A - Heat Chemistries

| Heat | Al (wt.%) | C (wt.%) | Cr (wt.%) | Fe (wt.%) | Mo (wt.%) | Nb (wt.%) | Ti (wt.%) | Si (wt.%) | Hardener Elements at % |
|---|---|---|---|---|---|---|---|---|---|
| 1Aa | 0.15 | 0.017 | 20.6 | 7.7 | 7.7 | 3.1 | 1.2 | 0.09 | 3.77 |
| 1Ab | 0.16 | 0.056 | 20.2 | 7.7 | 8.8 | 3.1 | 1.8 | 0.20 | 4.53 |
| 1Ac | 0.50 | 0.016 | 23.2 | 7.7 | 8.9 | 3.1 | 1.0 | 0.23 | 4.29 |
| 1Ad | 0.20 | 0.057 | 20.3 | 8.6 | 7.4 | 3.6 | 1.8 | 0.05 | 4.93 |
| 1Ae | 0.20 | 0.017 | 23.1 | 8.6 | 7.7 | 3.0 | 1.7 | 0.21 | 4.43 |
| 1Af | 0.50 | 0.054 | 20.8 | 7.8 | 9.0 | 3.7 | 1.3 | 0.07 | 5.03 |
| 1Ag | 0.52 | 0.016 | 23.2 | 8.7 | 7.8 | 3.6 | 1.2 | 0.07 | 4.89 |
| 1Ah | 0.53 | 0.052 | 20.8 | 8.7 | 7.7 | 3.1 | 1.2 | 0.20 | 4.60 |
| 1Ai | 0.56 | 0.015 | 20.4 | 7.7 | 7.6 | 3.6 | 1.8 | 0.21 | 5.72 |
| 1Aj | 0.19 | 0.049 | 23.4 | 7.7 | 7.6 | 3.6 | 1.1 | 0.21 | 4.05 |
| 1Ak | 0.60 | 0.050 | 23.2 | 7.7 | 7.7 | 3.1 | 1.8 | 0.07 | 5.49 |
| 1Al | 0.61 | 0.050 | 23.5 | 8.7 | 8.9 | 3.7 | 1.8 | 0.23 | 5.89 |
| 1Am | 0.57 | 0.013 | 20.6 | 8.8 | 9.0 | 3.1 | 1.9 | 0.07 | 5.54 |
| 1An | 0.17 | 0.012 | 20.6 | 8.8 | 9.0 | 3.7 | 1.2 | 0.21 | 4.19 |
| 1Ao | 0.20 | 0.051 | 23.3 | 8.7 | 8.8 | 3.0 | 1.1 | 0.05 | 3.69 |
| 1Ap | 0.22 | 0.014 | 23.3 | 7.6 | 8.9 | 3.6 | 1.6 | 0.08 | 4.73 |
| 1Aq | 0.15 | 0.015 | 20.2 | 7.9 | 7.7 | 3.1 | 1.3 | 0.08 | 3.89 |
| 1Ar | 0.61 | 0.050 | 23.5 | 8.7 | 8.9 | 3.7 | 1.8 | 0.23 | 5.89 |

FIG. 9

DoE1 Alloy A - Mechanical Properties

| Heat | 75°F Tensile Properties | | | | 750°F Tensile Properties | | | | Static Life In Steam (hrs) |
|---|---|---|---|---|---|---|---|---|---|
| | UTS | 0.2%YS | E | RA | UTS | 0.2%YS | E | RA | |
| 1Aa | 194 | 146 | 30 | 52 | 167 | 132 | 31 | 50 | 336 |
| 1Ab | 209 | 162 | 8 | 10 | 187 | 153 | 3 | 6 | 2,057 |
| 1Ac | 206 | 163 | 18 | 26 | 180 | 146 | 18 | 24 | 1,433 |
| 1Ad | 208 | 163 | 21 | 35 | 181 | 140 | 23 | 23 | 1,177 |
| 1Ae | 183 | 165 | < 1 | < 1 | 194 | 159 | 3 | 4 | * |
| 1Af | 202 | 170 | 15 | 18 | 179 | 148 | 19 | 25 | 1,291 |
| 1Ag | 217 | 170 | 6 | 4 | 202 | 162 | 3 | 7 | * |
| 1Ah | 190 | 149 | 27 | 35 | 163 | 136 | 26 | 38 | 1,446 |
| 1Ai | 205 | 166 | 13 | 12 | 182 | 145 | 15 | 18 | 1,354 |
| 1Aj | 207 | 168 | 14 | 21 | 183 | 158 | 16 | 27 | 1,411 |
| 1Ak | 229 | 192 | 2 | 2 | 221 | 176 | 3 | 4 | * |
| 1Al | 215 | 189 | < 1 | 4 | 212 | 170 | 1 | 4 | * |
| 1Am | 224 | 188 | 4 | 5 | 207 | 168 | 3 | 6 | * |
| 1An | 217 | 184 | 14 | 23 | 192 | 161 | 17 | 29 | 1,466 |
| 1Ao | 218 | 183 | 7 | 7 | 200 | 165 | 5 | 17 | 1,588 |
| 1Ap | 209 | 184 | < 1 | 3 | 181 | 162 | 2 | 4 | * |
| 1Aq | 189 | 131 | 32 | 55 | 161 | 118 | 35 | 56 | 107 |
| 1Ar | Failed during machining | | | | 178 | 178 | 0 | < 1 | ^ |

* Failed during the pre-cracking operation in manufacturing the compact tension specimen.

^ Failed during machining of the compact tension specimen.

No test performed.

FIG. 10

Alloy B Master Chemistry and DoE2 Element Levels

| Element | Nominal Chemistry (wt.%) | DoE2 Low (wt.%) | DoE2 High (wt.%) |
|---|---|---|---|
| Al | 0.40 | 0.20 | 0.60 |
| B | 0.003 | | |
| C | 0.025 | 0.005 | 0.05 |
| Co | 0.04 | | |
| Cr | 20.50 | 19.00 | 22.00 |
| Fe | 8.00 | 3.00 | 7.00 |
| Mo | 7.50 | 6.50 | 8.50 |
| Nb | 3.60 | 3.20 | 4.00 |
| V | 0.05 | | |
| Ni | 61.40 | | |
| Ta | 0.04 | | |
| Ti | 1.40 | 1.00 | 1.80 |
| Si | 0.10 | | |
| Mg | 0.003 | | |
| Ca | < 0.001 | | |
| Mn | 0.05 | | |
| P | < 0.005 | | |
| S | < 0.0005 | | |

FIG. 11

DoE2 Alloy B - Heat Chemistries

| Heat | Al (wt.%) | C (wt.%) | Cr (wt.%) | Fe (wt.%) | Mo (wt.%) | Nb (wt.%) | Ti (wt.%) | Hardener at % |
|---|---|---|---|---|---|---|---|---|
| 2Ba | 0.59 | 0.042 | 21.88 | 7.04 | 8.47 | 4.00 | 1.73 | 5.96 |
| 2Bb | 0.59 | 0.041 | 18.93 | 3.00 | 6.47 | 4.03 | 1.74 | 5.99 |
| 2Bc | 0.59 | 0.046 | 18.94 | 7.08 | 6.48 | 3.23 | 0.97 | 4.54 |
| 2Bd | 0.57 | 0.003 | 18.96 | 7.07 | 8.45 | 4.01 | 0.98 | 5.00 |
| 2Be | 0.60 | 0.046 | 21.86 | 3.05 | 8.53 | 3.20 | 0.99 | 4.57 |
| 2Bf | 0.20 | 0.003 | 18.89 | 3.04 | 6.45 | 3.20 | 0.99 | 3.69 |
| 2Bg | 0.39 | 0.026 | 20.38 | 5.07 | 7.43 | 3.60 | 1.37 | 4.83 |
| 2Bh | 0.57 | 0.003 | 18.90 | 3.05 | 8.42 | 3.21 | 1.78 | 5.48 |
| 2Bi | 0.18 | 0.004 | 21.81 | 3.03 | 8.44 | 4.00 | 1.77 | 5.12 |
| 2Bj | 0.56 | 0.003 | 21.91 | 6.99 | 6.49 | 3.22 | 1.78 | 5.46 |
| 2Bk | 0.25 | 0.004 | 18.99 | 7.08 | 6.45 | 3.98 | 1.67 | 5.13 |
| 2Bl | 0.18 | 0.050 | 21.86 | 7.09 | 6.44 | 3.98 | 0.99 | 4.15 |
| 2Bm | 0.21 | 0.042 | 18.94 | 7.11 | 8.44 | 3.20 | 1.74 | 4.64 |
| 2Bn | 0.37 | 0.024 | 20.41 | 5.10 | 7.44 | 3.58 | 1.38 | 4.79 |
| 2Bo | 0.39 | 0.022 | 20.38 | 5.07 | 7.44 | 3.60 | 1.37 | 4.83 |
| 2Bp | 0.24 | 0.041 | 21.90 | 3.04 | 6.47 | 3.22 | 1.71 | 4.68 |
| 2Bq | 0.20 | 0.003 | 21.94 | 7.07 | 8.41 | 3.19 | 0.95 | 3.64 |
| 2Br | 0.19 | 0.047 | 18.94 | 3.07 | 8.41 | 3.97 | 0.98 | 4.15 |
| 2Bs | 0.59 | 0.004 | 21.85 | 3.04 | 6.47 | 3.98 | 0.99 | 5.04 |

FIG. 12

DoE2 Alloy B - Mechanical Properties

| Heat | 75°F Tensile Properties | | | | 750°F Tensile Properties | | | | Static Life In Steam (hrs) |
|---|---|---|---|---|---|---|---|---|---|
| | UTS (KSi) | YS at 0.2% | E (%) | RA (%) | UTS (KSi) | YS at 0.2% | E (%) | RA (%) | |
| 2Ba | 242 | 202 | 4 | 6 | 217 | 179 | 3 | 4 | ∧ |
| 2Bb | 205 | 146 | 31 | 49 | 189 | 132 | 27 | 24 | 7 |
| 2Bc | 173 | 109 | 39 | 59 | 150 | 94 | 37 | 57 | ∧ |
| 2Bd | 179 | 122 | 41 | 61 | 154 | 102 | 42 | 60 | ∧ |
| 2Be | 179 | 118 | 38 | 56 | 152 | 101 | 34 | 48 | ∧ |
| 2Bf | 136 | 74 | 59 | 76 | 107 | 51 | 59 | 73 | ∧ |
| 2Bg | 190 | 132 | 32 | 56 | 160 | 120 | 22 | 54 | 103 |
| 2Bh | 189 | 130 | 35 | 51 | 167 | 110 | 34 | 44 | ∧ |
| 2Bi | 231 | 196 | 9 | 17 | 209 | 171 | 8 | 10 | 7 |
| 2Bj | 201 | 151 | 21 | 27 | 182 | 142 | 17 | 20 | ∧ |
| 2Bk | 215 | 165 | 26 | 48 | 192 | 149 | 26 | 50 | 3 |
| 2Bl | 198 | 158 | 28 | 54 | 166 | 137 | 17 | 53 | ∧ |
| 2Bm | 201 | 144 | 31 | 53 | 171 | 121 | 30 | 53 | 68 |
| 2Bn | 199 | 146 | 33 | 57 | 170 | 122 | 32 | 54 | ∧ |
| 2Bo | 189 | 131 | 34 | 60 | 169 | 121 | 35 | 57 | ∧ |
| 2Bp | 187 | 123 | 33 | 55 | 160 | 107 | 31 | 51 | ∧ |
| 2Bq | 178 | 131 | 34 | 58 | 149 | 112 | 33 | 59 | ∧ |
| 2Br | 205 | 155 | 28 | 53 | 182 | 144 | 28 | 48 | ∧ |
| 2Bs | 183 | 131 | 34 | 59 | 171 | 121 | 33 | 50 | ∧ |

* Failed during the pre-cracking operation in manufacturing the compact tension specimen.
∧ No test performed.

FIG. 13

DoE2 Solution Treatment Matrix

| Designation | Heat Treat Conditions |
|---|---|
| Original | Solution: 1800°F for 4 h, air cool to ambient |
| | Age: 1350°F for 8 h, furnace cool at 100°F/h to 1150°F, air cool to ambient |
| A | Solution: 1650°F for 1 h, oil quench to ambient |
| | Age: 1300°F for 8 h, furnace cool at 100°F/h to 1150°F, still air cool to ambient |
| B | Solution: 1700°F for 1 h, oil quench to ambient |
| | Age: 1300°F for 8 h, furnace cool at 100°F/h to 1150°F, still air cool to ambient |
| C | Solution: 1750°F for 1 h, oil quench to ambient |
| | Age: 1300°F for 8 h, furnace cool at 100°F/h to 1150°F, still air cool to ambient |
| D | Solution: 1650°F for 1 h, fan cool to ambient |
| | Age: 1350°F for 8 h, furnace cool at 100°F/h to 1150°F, still air cool to ambient |

FIG. 14

DoE2 Solution Treatment – Tensile Strength and Crack Growth Resistance

| Heat | Designation | 75°F Tensile Properties | | | | Static Life in Steam (hrs) |
|---|---|---|---|---|---|---|
| | | UTS | 0.2%YS | E | RA | |
| 2Bk | O | 214 | 163 | 26 | 43 | 9 |
| | A | 228 | 206 | 16 | 34 | 11,063 |
| | B | 219 | 184 | 21 | 33 | 9,429 |
| | C | 212 | 154 | 28 | 44 | 2,189 |
| | D | 221 | 199 | 15 | 33 | 72,041 |
| 2Bl | O | 190 | 150 | 26 | 56 | 43 |
| | A | 205 | 157 | 22 | 39 | 50,811 |
| | B | 203 | 152 | 30 | 48 | 20,092 |
| | C | 204 | 153 | 29 | 53 | 38 |
| | D | 210 | 180 | 19 | 39 | 9,844 |
| 2Bn | O | 200 | 147 | 33 | 56 | 34 |
| | A | 210 | 156 | 28 | 38 | 22,058 |
| | B | 200 | 139 | 31 | 54 | 1,036 |
| | C | 199 | 140 | 32 | 57 | 38 |
| | D | 214 | 171 | 16 | 31 | 9,844 |
| 2Bo | O | 204 | 155 | 28 | 52 | 6 |
| | A | 206 | 147 | 30 | 49 | 30 |
| | B | 208 | 149 | 30 | 52 | 10 |
| | C | 207 | 152 | 30 | 52 | 11 |
| | D | 206 | 147 | 27 | 47 | 6,583 |

FIG. 15

DoE3 - Chemical Composition: Fixed Elements

| Heat | Mn (wt.%) | Si (wt.%) | P (wt.%) | S (wt.%) | Cr (wt.%) | Ni (wt.%) | Mo (wt.%) | Fe (wt.%) | Co (wt.%) | V (wt.%) | Al (wt.%) | Ta (wt.%) | B (wt.%) |
|---|---|---|---|---|---|---|---|---|---|---|---|---|---|
| 3Ca | 0.05 | 0.05 | 0.005 | 0.0005 | 20.65 | 62.88 | 7.18 | 3.88 | 0.03 | 0.05 | 0.18 | 0.04 | 0.0028 |
| 3Cb | 0.04 | 0.04 | 0.005 | 0.0005 | 20.69 | 62.47 | 7.17 | 3.86 | 0.03 | 0.05 | 0.18 | 0.04 | 0.0029 |
| 3Cc | 0.05 | 0.04 | 0.005 | 0.0005 | 20.66 | 62.53 | 7.16 | 3.86 | 0.03 | 0.05 | 0.20 | 0.03 | 0.0027 |
| 3Cd | 0.05 | 0.04 | 0.005 | 0.0005 | 20.71 | 62.46 | 7.17 | 3.86 | 0.03 | 0.05 | 0.18 | 0.04 | 0.0028 |
| 3Ce | 0.05 | 0.04 | 0.005 | 0.0005 | 20.72 | 62.45 | 7.16 | 3.87 | 0.03 | 0.05 | 0.18 | 0.04 | 0.0025 |
| 3Cf | 0.04 | 0.04 | 0.005 | 0.0005 | 20.72 | 62.46 | 7.16 | 3.87 | 0.03 | 0.05 | 0.17 | 0.04 | 0.0026 |

FIG. 16

DoE3 - Chemical Composition: Variable Elements

| Heat | C (wt.%) | Ti (wt.%) | Nb (wt.%) | Hardener (at.%) | Ti (at.%) | Nb (at.%) | Ti + Nb (wt.%) |
|---|---|---|---|---|---|---|---|
| 3Ca | 0.040 | 1.37 | 3.62 | 4.39 | 1.684 | 2.295 | 4.99 |
| 3Cb | 0.007 | 1.92 | 3.47 | 4.97 | 2.360 | 2.200 | 5.39 |
| 3Cc | 0.010 | 1.75 | 3.61 | 4.89 | 2.151 | 2.289 | 5.36 |
| 3Cd | 0.010 | 1.63 | 3.77 | 4.80 | 2.003 | 2.390 | 5.40 |
| 3Ce | 0.011 | 1.47 | 3.92 | 4.70 | 1.807 | 2.485 | 5.39 |
| 3Cf | 0.009 | 1.33 | 4.07 | 4.60 | 1.635 | 2.580 | 5.40 |

FIG. 17

DoE3 Alloy C - Mechanical Properties

| Heat | 75°F Tensile Properties | | | | 750°F Tensile Properties | | | |
|---|---|---|---|---|---|---|---|---|
| | UTS (KSi) | YS at (0.2%) | E (%) | RA (%) | UTS (KSi) | YS at (0.2%) | E (%) | RA (%) |
| 3Ca | 218 | 187 | 19 | 36 | 194 | 172 | 20 | 38 |
| 3Cb | 223 | 193 | 17 | 25 | 195 | 165 | 17 | 31 |
| 3Cc | 221 | 191 | 19 | 35 | 199 | 172 | 23 | 39 |
| 3Cd | 223 | 191 | 21 | 27 | 196 | 166 | 18 | 30 |
| 3Ce | 223 | 193 | 23 | 41 | 203 | 175 | 22 | 35 |
| 3Cf | 219 | 187 | 20 | 35 | 197 | 169 | 23 | 39 |

FIG. 19

Comparison of Static Crack Growth for DoE3 and 706 Alloys

| Material | Orientation | Test Temp (°F) | Environment | Intial K | Act. TTF (hr) | Est. TTF (hr) |
|---|---|---|---|---|---|---|
| 706 2-step | C-L | 1100 | Air | 28 | 14.55 | - |
| 706 2-step | L-C | 1100 | Air | 28 | 18.75 | - |
| 706 2-step | L-R | 1100 | Air | 28 | 24.98 | - |
| Alloy 625 | - | 1100 | Steam | 26 | 1680 | - |
| Alloy 750 | - | 1100 | Steam | 26 | 2139 | - |
| 3Ca | Transverse | 1100 | Air | 28 | 353.86 | 71,638 |
| 3Cb | Transverse | 1100 | Air | 28 | 353.86 | 27,485 |
| 3Cc | Transverse | 1100 | Air | 28 | 353.86 | 22,362 |
| 3Cd | Transverse | 1100 | Air | 28 | 342.21 | 2,455 |
| 3Ce | Transverse | 1100 | Air | 28 | 342.21 | 1,484 |
| 3Cf | Transverse | 1100 | Air | 28 | 221.80 | - |

FIG. 20

Preferred Alloy Chemistry+ (values in weight percent)

| Element | Aim Chemistry | Minimum | Maximum |
|---|---|---|---|
| Carbon | 0.010 | | 0.040 |
| Chromium | 20.70 | | |
| Molybdenum | 7.20 | | |
| Iron | 4.00 | | |
| Aluminum | 0.20 | | |
| Niobium | 3.60 | 3.40 | 3.80 |
| Titanium | 1.60 | 1.40 | 1.80 |
| Manganese | 0.05 | | |
| Silicon | 0.05 | | |
| Phosphorous | 0.005 | | |
| Sulfur | 0.0005 | | |
| Cobalt | 0.03 | | |
| Vanadium | 0.05 | | |
| Tantalum | 0.04 | | |
| Boron | 0.003 | 0.0025 | 0.0035 |

+ - in addition, the weight fraction of Ti + Nb in the alloy should be between about 4.99 and about 5.40.

200 μm

200 μm

METHOD OF HEAT TREATING A NI-BASED SUPERALLOY ARTICLE AND ARTICLE MADE THEREBY

BACKGROUND OF THE INVENTION

The subject matter disclosed herein relates to a method of heat treating Ni-base superalloys and articles made thereby. More particularly, it relates to a method of heat treating Ni-base superalloys to provide desirable yield strength, ductility and high temperature hold-time crack resistance and articles made thereby.

High temperatures and stresses are normally encountered during operation of jet and land-based turbine engines. The components within these turbine engines must retain high strength under load and other properties at temperatures in excess of 850° F. in order to ensure reliable turbine function over extended periods of operation. Ni-base superalloys have long been recognized as having properties at elevated temperatures that make them desirable for use in critical turbine components that have high operating temperatures, such as turbine wheels, combustors, spacers, blades/vanes and the like. Precipitates of a γ" are believed to contribute to the superior performance of many of these Ni-base superalloys at high temperatures. Consequently, Ni-base superalloys such as Alloy 706, Alloy 718, Alloy 625 and Alloy 725 have been widely used to form these components in turbines that are used for land-based power generation.

Industrial gas turbine rotors manufactured from Alloy 706 and given the industry standard two-step aging heat treatment in the past have experienced cracking along grain boundaries during operation prior to full life. This problem has been partially addressed by more stringent manufacturing processes including surface processing that induces compressive residual stresses and by manufacturing newer rotors from Alloy 718 or Alloy 706 that has been given a two-step aging heat treatment. However, as the operating temperature and stress requirements for industrial gas turbine and steam turbines are increased, neither Alloy 706, Alloy 718, Alloy 725 or Custom Age 625 PLUS) will satisfy these requirements, and must be replaced by alloys with a better combination of strength, ductility and hold-time crack resistance, while also maintaining excellent corrosion resistance, preferably corrosion resistance at least as high as that of Alloy 706 and Alloy 718, and more preferably at least as high as that of Alloy 725 and Custom Age 625 PLUS.

Therefore, it is desirable to develop Ni-base superalloys that enjoy improved TDCPR, strength and ductility and that also provide excellent corrosion resistance, as well as methods of making such Ni-base superalloys.

BRIEF DESCRIPTION OF THE INVENTION

According to one aspect of the invention, a method of heat treating a Ni-base superalloy article is disclosed. The method includes hot-working an article comprising an NiCrMoNbTi superalloy comprising, in weight percent, at least about 55 Ni to produce a hot-worked microstructure. The method also includes solution treating the article at a temperature of about 1600° F. to about 1750° F. for about 1 hour to about 12 hours to form a partially recrystallized warm-worked microstructure. The method also includes cooling the article. The method also includes precipitation aging the article at a first precipitation aging temperature of about 1300° F. to about 1400° F. for a first duration of about 4 hours to about 12 hours. Further, the method includes cooling the article to a second precipitation aging temperature. Still further, the method includes precipitation aging the article at a second precipitation aging temperature of about 1150° F. to about 1200° F. for a second duration of about 4 hours to about 12 hours. Still further, the method includes cooling the article from the second precipitation aging temperature to an ambient temperature.

According to another aspect of the invention, an NiCrMoNbTi superalloy article comprising, in weight percent, at least about 55 Ni and having a partially-recrystallized hot-worked microstructure.

According to yet another aspect of the invention, an NiCRMoNbTi superalloy comprising, in weight percent, at least about 55 Ni having a partially-recrystallized, hot-worked microstructure and a static crack propagation resistance at about 1100° F. in air of at least about 2400 hours.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

FIG. 7 is a table of Alloy A Master Chemistry and DoE1 Element Levels as disclosed herein;

FIG. 8 is a table of DoE1 Alloy A Heat Chemistries as disclosed herein;

FIG. 9 is a table of DoE1 Alloy A Mechanical Properties as disclosed herein;

FIG. 10 is a table of Alloy B Master Chemistry and DoE2 Element Levels as disclosed herein;

FIG. 11 is a table of DoE2 Alloy B Heat Chemistries as disclosed herein;

FIG. 12 is a table of DoE2 Alloy B Mechanical Properties as disclosed herein;

FIG. 13 is a table of DoE2 Solution Treatment Matrix as disclosed herein;

FIG. 14 is a table of DoE2 Solution Treatment Tensile Strength and Crack Growth Resistance as disclosed herein;

FIG. 15 is a table of DoE3 Chemical Composition: Fixed Elements as disclosed herein;

FIG. 16 is a table of DoE3 Chemical Composition: Variable Elements as disclosed herein;

FIG. 17 is a table of DoE3 Alloy C Mechanical Properties as disclosed herein;

FIG. 19 is a table of a Comparison of Static Crack Growth for DoE3 and Alloy 706 alloys as disclosed herein FIG. 20 is a table of a Preferred Alloy Chemistry (values in weight percent) as disclosed herein;

Figure 1:
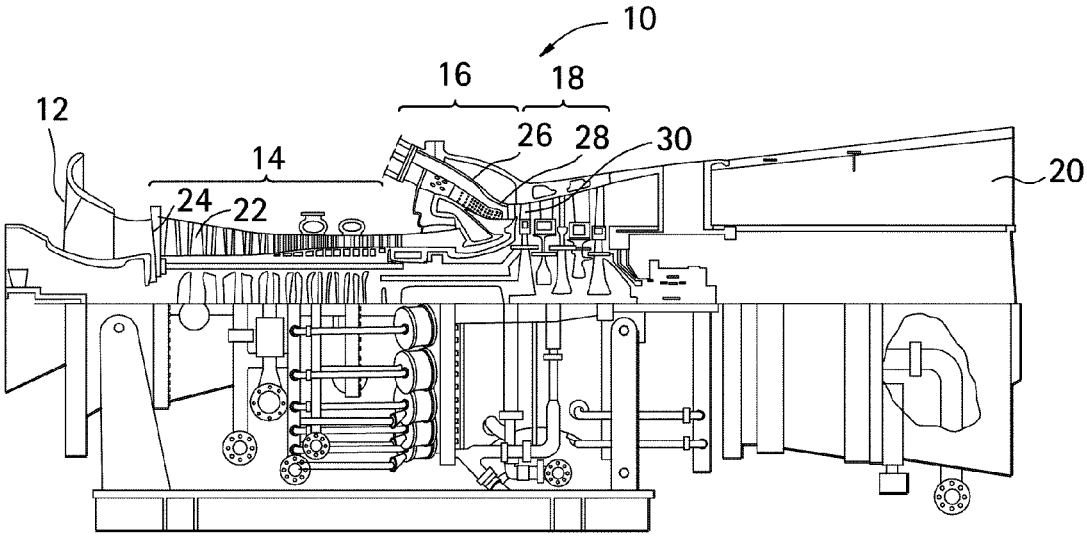
FIG. 1 is a cross-sectional schematic view of an exemplary embodiment of a turbine engine having a turbine component comprising an alloy as disclosed herein.

The detailed description explains embodiments of the invention, together with advantages and features, by way of example with reference to the drawings.

DETAILED DESCRIPTION OF THE INVENTION

For the purposes of this specification, the appearance of the adverb "about" before a single or series of values shall be interpreted to encompass each and every value unless expressly indicated to the contrary.

In the following description, like reference characters designate like or corresponding parts throughout the several views shown in the Figures. The use of terms such as "top," "bottom," "outward," "inward," and the like are words of convenience and are not to be construed as limiting terms.

A heat treatment method to improve the room temperature and operating temperature strength, including the yield strength, room temperature and operating temperature ductility and TDCPR of cast and forged Ni-based superalloys relative to existing commercial alloys, including those comprising versions of Alloy 725 or Custom Age 625 PLUS, as well as those of Alloy 718 or Alloy 706, two-step age is disclosed, as well as the alloys having a resultant microstructure or combination of mechanical properties characteristic of the application of this heat treatment methodology. For example, as used commercially, Alloy 706 two-step age has an average 0.2% yield strength (YS)≦148 ksi, an ultimate tensile strength (UTS) 183 ksi and an RA≦24%. Advantageously, the alloys described herein and processed according to the methods disclosed herein also are expected to have better corrosion resistance than either Alloy 706 or Alloy 718 since this is known to be the case for conventional commercial alloys of these materials.

These highly corrosion resistant, precipitation or age hardenable Ni-based superalloys may be described generally as NiCrMoNbTi superalloys that may also include incidental or trace amounts of B, Co, Ta and V. The heat treatment methodology disclosed is suitable for use with conventionally cast and forged INCONEL® Alloy 725 (UNS N07725) made by Special Metals Corporation and others and Custom Age 625 PLUS® Alloy (UNS N07716) made by Carpenter Technology. The primary difference between these alloys is the amount of Ni in the alloy, as further described herein. Thus, the composition of the Ni-base superalloys includes, in weight percent, about 55.0-63.0% Ni, about 19.0-22.5% Cr, about 6.5-9.5% Mo, about 2.75-4.5% Nb, about 1.0-2.3% Ti, up to about 0.35% Al, up to about 0.35% Mn, up to about 0.20% Si, up to about 0.010% S, up to about 0.20% C and up to about 0.015% P, with the balance Fe and incidental or trace impurities. These Ni-base superalloys may also include, in weight percent: up to about 0.05 V, up to about 0.05 Ta, up to about 1.0 Co or up to about 0.02 B, or a combination thereof, as incidental impurities or as trace alloying additions, and more particularly may include amounts of Co of 0.20 or less and B of 0.006 or less. The nominal commercial compositions of Alloy 725 (UNS N07725) and Custom Age 625 PLUS® (UNS N07716) are given in Table 1 below:

TABLE 1

| Chemical Composition (wt. %) | Alloy 725 (UNS N07725) | Alloy 625 (UNS N07716) |
|---|---|---|
| Ni | 55.0-59.0 | 57.0-63.0 |
| Chromium | 19.0-22.5 | 19.0-22.0 |
| Molybdenum | 6.5-9.5 | 7.0-9.5 |
| Niobium | 2.75-4.5 | 2.75-4.0 |
| Titanium | 1.0-2.3 | 1.0-1.6 |
| Aluminum | 0.35 max. | 0.35 max. |
| Carbon | 0.03 max. | 0.20 max. |
| Manganese | 0.35 max. | 0.20 max. |
| Silicon | 0.20 max. | 0.20 max. |
| Phosphorus | 0.015 max. | 0.015 max. |
| Sulfur | 0.010 max. | 0.010 max. |
| Commercial Impurities | Trace | Trace |
| Iron | Balance | Balance |

The Ni-base superalloy compositions also include several additional alloy compositions described in the examples reported herein. These alloys include C, Ti, and Nb in any combination acting as hardening constituents, wherein, in weight percent, C is about 0.007 to about 0.011, Ti is about 1.33 to about 1.92, Nb is about 3.47 to about 4.07 and the total amount of Ti plus Nb is about 4.99 to about 5.40 in atomic percent, and wherein the total amount of hardening constituents in atom percent is about 4.39 to about 4.97.

Referring to FIG. 1 in particular, it will be understood that the illustrations are for the purpose of describing an exemplary embodiment of the invention and are not intended to limit the invention thereto. It is understood that articles other than turbine articles or components, for which the combination of strength, ductility and TDCPR are desired, are considered to be within the scope of the present invention. Such articles include, but are not limited to, tooling, valves, and down-hole equipment used in oil field operations, rocket engines, spacecraft, petrochemical/energy production, internal combustion engines, metal forming (hot-working tools and dies), heat-treating equipment, nuclear power reactors, and coal conversion equipment. FIG. 1 is a schematic diagram of a turbine engine 10 that includes at least one turbine engine component of the present invention, as described below. The turbine engine 10 may either be a land-based turbine, such as those widely used for power generation, or an aircraft or marine engine. Air enters the inlet 12 of the turbine engine 10 and is first compressed in the compressor 14. The high pressure air then enters the combustor 16 where it is combined with a fuel, such as natural gas or jet fuel, and burned continuously. The hot, high pressure combustion gases exiting the combustor 16 are then expanded through a turbine 18, where energy is extracted to provide the motive power of the turbine, including energy to power the compressor, before exiting the turbine engine 10 through a discharge outlet 20.

The turbine engine 10 comprises a number of turbine components or articles that are subject to high temperatures and/or stresses during operation. These turbine components include, but are not limited to: rotors 22 and stators 24 in the compressor 14; combustor cans 26 and nozzles 28 in the combustor 16; discs, wheels and buckets 30 in the turbine 18; and the like. The turbine components may be formed from Ni-base superalloys having compositions in the ranges described herein and a crack propagation resistance (TDCPR) of at least 2400 hours to failure at 1100° F. in the presence of air under the conditions described herein. Preferably, the turbine components have a crack propagation resistance of at least 20,000 hours to failure at 1100° F. in the presence of air. Most preferably, the turbine engine 10 includes turbine components having a TDCPR of at least 70,000 hours to failure at 1100° F. in the presence of air.

Figure 2:
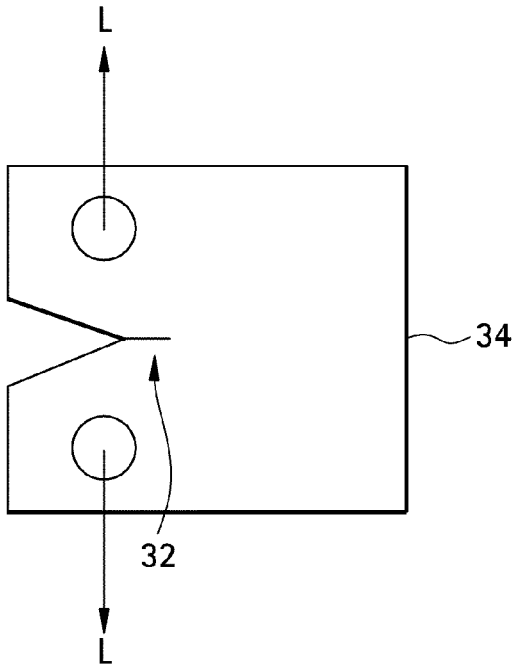
FIG. 2 is a front view of a static crack growth test specimen as disclosed herein.

FIG. 2 is a schematic representation of a static crack growth test for determining the crack propagation resistance of a material or an article formed from the material. A fatigue pre-crack 32 to provide a stress intensity factor of K=28 ksi-$(in)^{1/2}$ is created in a test article 34 formed from the material and the test article 34 subjected to a constant load (L) (e.g., 1099 lbs.) and is heated to the test or service temperature (e.g., 1100° F.) in the presence of air or steam. A steam environment may be used in the static growth tests because steam is generally considered to be a somewhat more hostile environment than air for intergranular cracking in Ni-base superalloys. Thus, test results obtained in the presence of steam for the alloys represent a lower performance limit of the alloys. A stress intensity factor (e.g., 28 ksi-$(in)^{1/2}$) is applied to the fatigue pre-crack 32. The growth rate of the fatigue pre-crack 32 is monitored until the test article 34 fails, or until a preselected time is reached, in which case the time dependent portion of the crack advance is measured. Depending on whether the test article 34 fails or the preselected time is reached, either the time to failure or the degree of crack advance can be correlated with static crack growth rates.

The article of the present invention, which may be a turbine component of the turbine engine 10, is formed from a Ni-base superalloy as described herein. The Ni-base superalloy used to form the article has a microstructure that includes a gamma prime (γ') phase ($Ni_3Al$, Ti) and a gamma double prime (γ") tetragonal phase $Ni_3$(Al, Ti, Nb) and comprises NiCrMoNbTi superalloys having, in weight percent, at least 55% Ni and a partially recrystallized, hot-worked microstructure. The degree of partial recrystallization may vary. It will include at least some recrystallization, such that the bimodal grain structure described herein is present, but may range from relatively small amounts of recrystallized grains and large amounts of the warm worked microstructure and relatively large amounts of recrystallized grain and small amounts of the warm worked microstructure.

The articles also have a 0.2% yield strength of at least about 187 ksi at about room temperature and at least about 165 ksi at about 750° C. More particularly, they have a 0.2% yield strength of about 187 ksi to about 193 ksi at about room temperature and about 165 ksi to about 175 ksi at about 750° C. These articles also have an RA of at least about 24% at about room temperature and at least about 31% at about 1150° C. and an improved hold-time crack propagation resistance or TDCPR in steam and/or air at 1100° F. that is between about 1000 to about 3000 times better than 706 two-step age material, including hold-time crack propagation time to failure (TTF) of at least about 2400 hours in air at this temperature, and more particularly, at least about 2455 hours in air.

The articles described are formed from a Ni-base superalloy. The Ni-base superalloy has a partially-recrystallized, hot-worked microstructure having the mechanical properties described herein. The Ni-base superalloys described herein can preferably be made by what is commonly referred to as a "triple melt" process; although it is readily understood by those of ordinary skill in the art that alternate processing routes may be used to obtain them. In the triple melt process, the constituent elements are first combined in the necessary proportions and melted, using a method such as vacuum induction melting or the like, to form a molten alloy. The molten alloy is then resolidified to form an ingot of the Ni-base superalloy. The ingot is then re-melted using a process such as electroslag remelting (ESR) or the like to further refine and homogenize the alloy. A second re-melting is then performed using a vacuum arc re-melting (VAR) process to even further refine and homogenize the alloy and provide Ni-base superalloys of the types described that have sufficiently low inclusions and other desirable aspects to enable their use for making turbine engine articles 12.

Following the second re-melt, the alloy ingot is further homogenized by a heat treatment. The homogenizing heat treatment is preferably performed at a temperature that is as close to the melting point of the alloy as practical or possible, while at the same time avoiding incipient melting. The ingot is then subjected to a conversion process, in which the ingot is billetized; i.e., prepared and shaped for forging. The conversion process is carried out at temperatures below that used during the homogenization treatment and typically includes a combination of upset, heat treatment, and drawing steps in which additional homogenization occurs and the grain size in the ingot is reduced. The resulting billet is then hot-worked using conventional hot-working means, such as hot forging, hot bar forming, hot rolling or the like, or a combination thereof, to form the article.

Figure 3:
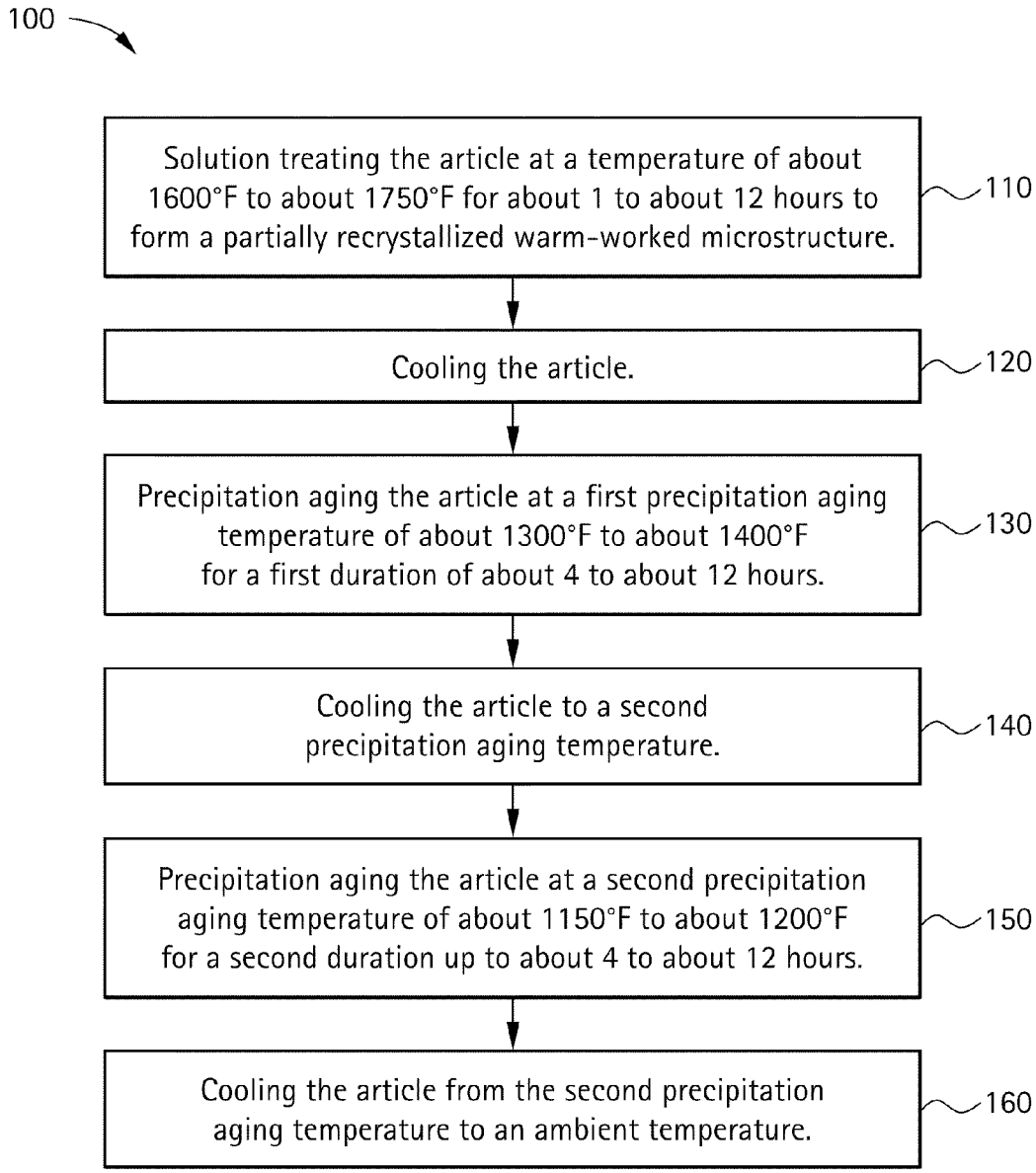
FIG. 3 is a flow chart of an exemplary embodiment of a heat treatment method as disclosed herein.

Referring to FIG. 3, the hot worked article is then heat treated to obtain the desired yield strength, ductility and TDCPR or hold-time crack growth resistance described herein. The heat treatment method described may be employed upon cooling directly after hot-working is performed, or upon reheating the article to the solution treatment temperature described herein. The heat treatment method 100 includes solution treating 110 the article at a solution-treatment temperature of about 1600° F. to about 1750° F. for about 1 hour to about 12 hours to form a partially recrystallized hot-worked microstructure; cooling 120 the article; precipitation aging 130 the article at a first precipitation aging temperature of about 1300° F. to about 1400° F. for a first duration of about 4 hours to about 12 hours; cooling 140 the article to a second precipitation aging temperature; precipitation aging 150 the article at a second precipitation aging temperature of about 1150° F. to about 1200° F. for a second duration of about 4 to about 12 hours; and cooling 160 the article to an ambient temperature.

Solution treating 110 the article at a temperature of about 1600° F. to about 1750° F. for about 1 hour to about 12 hours to form a partially recrystallized hot-worked microstructure is a relatively "low temperature" solutionizing heat treatment and may be described as a partial solution heat treatment, and is characterized by the fact that the temperature ranges and times utilized are not sufficient to fully recrystallize the alloy microstructure. More particularly, solution treating 100 may be performed at about 1600° F. to about 1750° F. for about 1 hour to about 8 hours and even more particularly at about 1650° F. to about 1750° F. for about 1 to about 3 hours. By way of comparison, for example, Custom Age 625 PLUS Alloy and Alloy 725 typically receive one of the following heat treatments for properties: (1) solution age heat treatment at 1900° F. for 1 hour to 2 hours after hot working operations (forging, bar forming, etc.) followed by air cooling to room temperature; (2) solution age as per (1) followed by a double age to develop γ" of 1325 to 1375° F. for 8 hours followed by furnace cooling at 100° F. per hour to 1150° F. where the alloy is heat treated for an additional 8 hours followed by air cooling to room temperature; (3) solution age as per (1) followed by single age to develop γ" of 1350° F. for 4 hours to 8 hours followed by air cooling to room temperature; (4) the alloy is hot worked and immediately given a double age at 1350° F. for 8 hours followed by a furnace cool at 100° F. per hour to 1150° F. where the alloy is heat treated for an additional 8 hours followed by air cooling to room temperature; and (5) cold worked followed by the standard aging heat treatment to develop γ" as described in (2), (3) or (4). The solution age heat treatment at 1900° F., or even a temperature as low as 1800° F., for 1 hour to 2 hours is sufficient to completely recrystallize the alloy microstructure.

Without being limited by theory, the post-forging solutionizing heat treatment was carried out in the γ phase field below the δ($Ni_3Nb$)-solvus temperature, such that this phase is not completely solutionized, but above the γ' and γ" solvus temperatures, such that these phases are substantially completely solutionized. Heat treatment at these temperatures and time durations is not sufficient to fully recrystallize the alloy microstructure, but rather only causes partial recrystallization, which means that the article retains a portion of its hot-worked microstructure, including relatively larger deformed and elongated grains characteristic of hot-working. The degree of partial recrystallization will be a function of the solutionizing temperature and duration, with relatively higher temperatures and longer times producing a relatively higher degree or quantity of recrystallized microstructure, and relatively lower temperatures and shorter times causing retention of greater amounts of the unrecrystallized hot-worked microstructure to be retained.

Again, without being limited by theory, the step of cooling 120 the partially recrystallized hot-worked microstructure fixes the degree of partial recrystallization as described above and also promotes the nucleation of γ' and γ" within the alloy microstructure. In an exemplary embodiment, cooling 120 may include cooling the article 12 to room temperature (e.g., about 70° F.), such as by air cooling or fan cooling to the ambient or room temperature followed by reheating 125 the article to the first precipitation aging temperature. Alternately, cooling 120 may include cooling the article directly to the first precipitation aging temperature, such as fan cooling or furnace cooling to the first precipitation aging temperature. Cooling 120 should promote relatively quick passage of article 12 through the γ' and γ" phase fields, such that nucleation of these phases is promoted without significant growth thereof.

Yet again, without being limited by theory, the step of precipitation aging 130 the article at a first precipitation aging temperature of about 1300° F. to about 1400° F. for a first duration of about 4 hours to about 12 hours is substantially directed to growth of the γ' and γ" phases that have been nucleated within the alloy microstructure. More particularly, the duration of this aging heat treatment may be about 5 hours to about 8 hours. The initial portion of about 1 hour to about 2 hours promotes growth of the γ' phase, while the final portion of about 3 hours to about 10 hours, or more particularly about 4 hours to about 6 hours, promotes growth of the γ" phase. In addition to the growth of the γ' and γ" phases, precipitation aging 130 also promotes the formation and or growth of additional carbides, including $M_{23}C_6$ or $M_6C$ carbides, or a combination thereof.

Yet again, without being limited by theory, the step of cooling 140 the article to a second precipitation aging temperature takes the alloy out of the γ" phase field through the γ' phase field and into the γ phase field. Cooling 140 from the first precipitation aging temperature to the second precipitation aging temperature may include furnace cooling at a controlled cooling rate. In an exemplary embodiment, the controlled cooling rate may include a rate of about 100° F./hr.

Still further, without being limited by theory, the step of precipitation aging 150 the article at a second precipitation aging temperature of about 1150° F. to about 1200° F. (i.e., in the γ phase field) for a second duration of about 4 to about 12 hours promotes coarsening of the γ' and γ" phases grown in the first precipitation aging step, resulting in a partially-recrystallized, hot-worked microstructure having somewhat coarsened γ' and γ" phases. More particularly, the duration of this aging heat treatment may be about 5 hours to about 8 hours.

Figure 4:
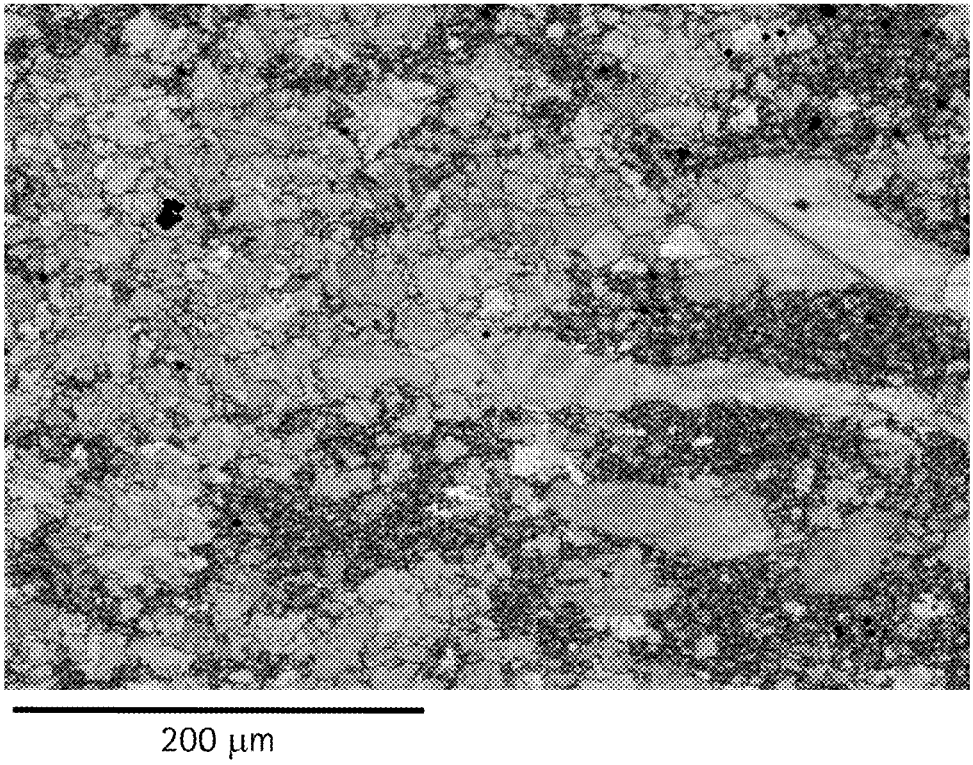
FIG. 4 is a photomicrograph of an exemplary embodiment of partially-recrystallized, hot-worked microstructure of an alloy as disclosed herein.

Upon completion of the second precipitation aging 150, method 100 also includes cooling 160 the article to an ambient or room temperature, such as by air cooling. No further phase transformations occur in conjunction with cooling 160. The partially-recrystallized, hot-worked microstructure having somewhat coarsened γ' and γ" phases has a bimodal, bimorphic grain microstructure that includes larger, and generally elongated grains associated with the unrecrystallized hot-worked portion of the microstructure that are interspersed with smaller, more equiaxed grains associated with the recrystallized portion of the microstructure. This microstructure is illustrated in FIG. 4. Without being limited by theory, the bimodal, bimorphic grain microstructure having the coarsened γ' and γ" phases is believed to promote the improved yield strength, ductility and hold-time crack resistance or TDCPR described herein by offering increased grain boundary length and tortuosity to any crack that is initiated within article 12 during operation, thereby slowing crack propagation.

With the alloy chemistries and heat treatment schedule described in exemplary embodiments in this application, a high strength, high ductility alloy superior to any current material is disclosed. These alloys and heat treatment schedules will allow manufacture of turbine articles with improved operating life relative to those employing other current commercial Ni-base superalloys, as described herein. This development facilitates the development of new industrial gas and steam turbines that are designed to operate at higher operating temperatures or higher stresses or both, with concomitant increases in turbine efficiency.

EXAMPLES

Three DoE's were performed to assess chemistry, mechanical strength and TDCPR capability as measured by the hold-time crack growth resistance of the alloy in steam and/or air. A range of solution heat treatment temperatures were explored starting with the standard industry solution age at 1900° F. and working downward in temperature to 1650° F. Aging heat treatments were performed at 1300, 1350 and 1400° F. for 8 hours followed by 100° F. furnace cool to 1150° F. or 1200° F. (for the high temperature precipitation aging treatment), also for 8 hours before air cooling to room temperature.

Three experimental design matrices were developed and executed according to a design of experiments (DoE) methodology. These DoE's were designed to examine chemistry extremes and heat treatment effects in order to evaluate static hold-time crack growth resistance (TDCPR), as well as yield strength, including 0.2%YS at room temperature (e.g., 70° F.) and 750° F. and ductility as measured by reduction in area (RA) at room temperature and 750° F. The first two DoE's looked at variation in constitutive elements of the base alloy chemistry in order to evaluate the affect of the alloy constituents. Associated with these DoE's were heat treatments designed to evaluate static hold-time crack growth resistance, yield strength and ductility.

The first two DoE's set the major alloy chemical constituents. However, in order to more fully explore the effect of hardener elements, a third DoE was initiated. In this case laboratory alloys were manufactured where Ti and Nb were varied such that the total hardener content remained the same, i.e., the Ti+Nb fraction was constant while the % hardener varied with the relative fraction of Ti and Nb. Since the desired heat treatment schedule described herein had been identified, these alloys were given this desired heat treatment and tensile behavior and static crack growth resistance were measured and compared to Alloy 706 (two-step age) as a comparative example.

Figure 5:
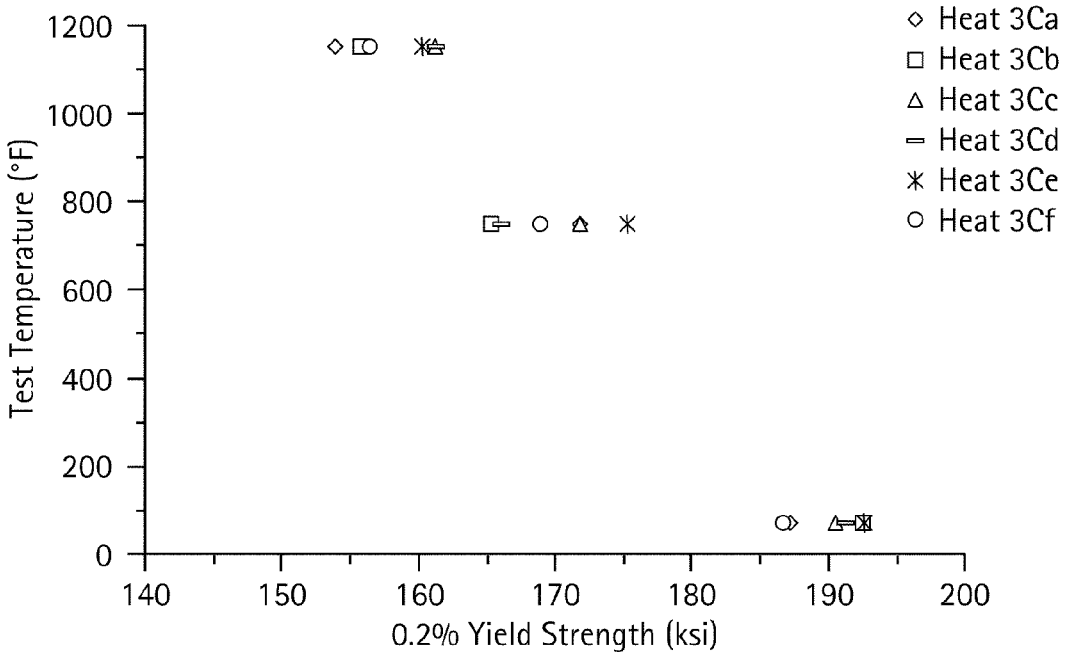
FIG. 5 is a plot of 0.2% yield strength versus test temperature of exemplary embodiments of alloys as disclosed herein.
Figure 6:
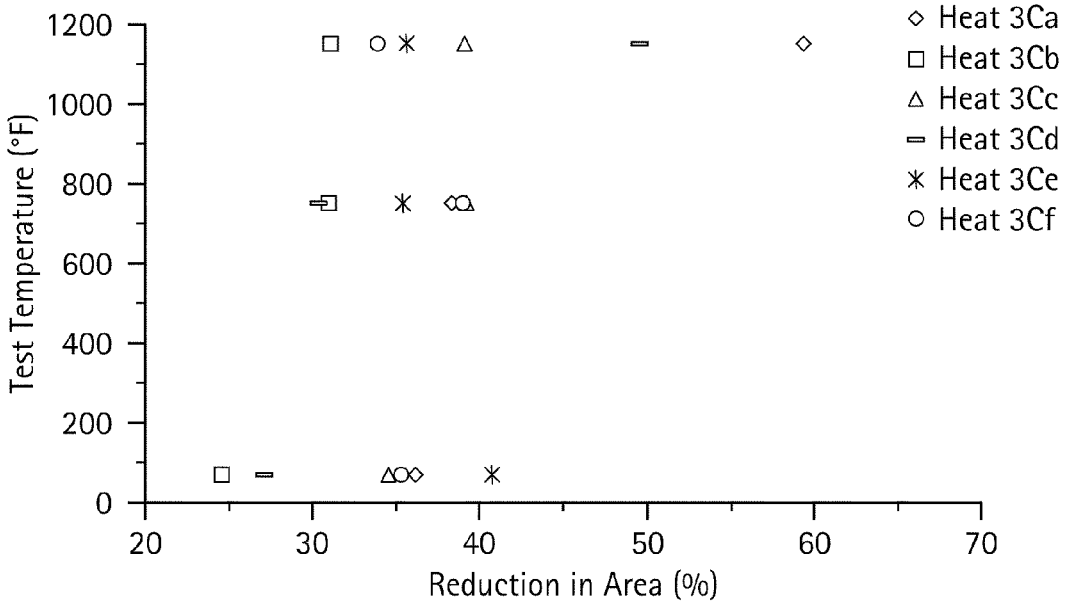
FIG. 6 is a plot of reduction of area (RA) versus test temperature of exemplary embodiments of alloys as disclosed herein.

The tensile properties from the third DoE were quite good. All DoE trial chemistries (including a baseline) exceeded 150 ksi 0.2% YS at 750° F. The 0.2% YS values ranged from a low of about 165 ksi to a high of about 175 ksi. In addition the room temperature RA also exceeded 15%, with a low of about 24% and a high of about 40%. FIG. 5 shows a graph of the change in 0.2% YS with temperature for the trial heats in DoE 3. FIG. 6 shows the reduction in area (RA) as a function of temperature for the same trial heats.

In addition the strength and ductility achieved, the static hold-time crack growth resistance (TDCPR) was also improved over Alloy 706 (two-step age). Static crack growth tests in air for the DoE alloys was compared against similar results for the 706-baseline alloy in the two-step age conditions and demonstrated improvement in crack growth resistance over these alloys.

DoE1

DoE1 was the initial exploration of these alloys in commercial form, i.e., produce an ingot up to 36" in diameter that could be cast and billetized without cracking and could subsequently be forged into articles (e.g., rotor disks) with a fine grain size. This ingot was used as the master alloy in evaluating the effect of chemistry on mechanical behavior. The eight elements in Alloy A were varied at two levels (high and low) for a 1/16 factorial DoE1. FIG. 7 contains the nominal chemistry as defined at the start of DoE1. Alloy A in the form of laboratory heats was based on this master chemistry with the following eight elements varied in DoE1: Al, C, Cr, Fe, Mo, Nb, Ti and Si, as shown in FIG. 8.

Each heat of Alloy A was forged to bar and subsequently rolled into plate to yield a relatively fine grain size. The dependent variables in these studies were: 1) tensile strength, yield strength, elongation, and reduction of area at 75° F.; 2) tensile strength, yield strength, elongation, and reduction of area at 750° F.; and 3) time to failure or estimated life measured in hours for a static crack growth test at 1100° F.

The atomic percent (at. %) hardener for each laboratory heat chemistry was determined using the following expression, where the elemental fraction is in weight percent (wt. %):

$$\text{Hardener at. \%} = 1229\times\text{Ti wt. \%} + 2.182\times\text{Al wt \%} + 0.634\times\text{Nb wt \%} + 0.325\times\text{Ta wt \%} \quad (1)$$

The at. % hardener varied between 3.69 and 5.89 for the heats produced in DoE1.

The static crack growth test is a screening test rather than a measurement of a design property, but is directly proportional to TDCPR. It is much less expensive than lengthy TDCPR tests performed near the operating temperature. The test can be conducted in air and/or steam. In DoE1, compact tension specimens having a crack that provided a stress intensity factor of K=28 ksi-(in.)$^{1/2}$ were hung in chains of five specimens at a constant load. for a maximum of two weeks (336 hours). If the specimen did not fail, the specimen was broken and the time to failure estimated using the extent of crack growth during exposure at 1100° F. (FIG. 9). An algorithm developed for this test was applied to determine the expected lifetime for this loading condition and temperature. It was not possible to perform static life tests of all of the DoE1 alloy chemistries because some were so brittle that they failed during pre-cracking of the compact tension specimen.

The actual DoE1 chemistries (high and low values) and material property data (0.2% yield strength, ultimate tensile strength, elongation, reduction in area and static crack growth life) for alloy A is shown in FIG. 9.

Alloy 718 possesses TDCPR better than that of Alloy 706 and was used as a comparative example for these static life results. Under these test conditions, the life of Alloy 718 is approximately 20 hours.

The heat treatment given to Alloy A in DoE1 was as follows: 1) solution heat treatment at about 1650° F. for about 1 hour; followed by 2) rapid cooling via oil quench to about ambient temperature; 3) heating to a first precipitation aging heat treatment temperature of about 1350° F. for about 8 hours; followed by 4) furnace cooling at about 100° F./hour to about 1150° F. temperature, and 5) holding at a second precipitation aging temperature of about 1150° F. for about 8 hours; and 6) subsequent still air cooling to ambient.

A very low solution treatment temperature was selected for DoE1. This solution temperature gave an unusual microstructure that was not fully recrystallized, retaining a portion of the hot-worked microstructure.

DoE2

DoE2 followed upon DoE1 in that the master chemistry of Alloy A was extended to include trace elements usually found in nickel superalloys. These elements included P, S, Co, Ta, V, and Ca, and were kept at reasonable trace amounts or as low as possible typical for Ni-base superalloys, particularly Alloy 725 and Alloy Custom 625 PLUS. In DoE2 Alloy B was based on this master chemistry and the following seven elements were varied: Al, C, Cr, Fe, Mo, Nb and Ti, yielding a one-eight fractional factorial DoE with three center points. FIG. 10 shows the nominal chemistry of Alloy B and the DoE2 high and low ranges for these seven elements. In addition midpoint chemistry between the high and low DoE2 range were also produced. A higher solution temperature (1800° F.) was selected for DoE2 to fully recrystallize the material.

DoE2 Heat Treatment

The solution and age heat treatment given to the laboratory Alloy B heat in DoE2 was as follows: 1) solution heat treat at about 1800° F. for 4 hours; 2) followed by air cooling to ambient temperature; 3) reheating to a first precipitation aging heat treatment temperature of about 1350° F. for 8 hours; followed by 4) furnace cooling at about 100° F./hour; and 5) holding at a second precipitation aging heat treatment temperature of about 1150° F. for about 8 hours; and 6) air cooling to ambient.

The change in solution treatment temperature from 1650° F. to 1800° F. in DoE2 adversely affected the static crack growth resistance of the material. As a result selected laboratory heats were re-solution treated and aged to determine the best solution treatment temperature. The materials used were ingots of Alloy B, i.e., 2Bk, 2Bl, 2Bn and 2Bo were given heat treatments according to designations in FIG. 13.

Heats 2Bk, 2Bl, 2Bn and 2Bo were subsequently tested for strength at room temperature and crack growth resistance in steam at 1100° F. The results of this solution treatment study are shown in FIG. 14.

Solution treatments A and D (1650° F.) provided the best results for static crack growth resistance of the solution treatments investigated. The main differences in the A and D heat treatments were quench approach from the solution temperature (oil quench (A) versus fan cool (D)) and the aging temperature (1300° F. for (A) versus 1350° F. for (D)).

DoE2 defined the solution treatment and age temperatures for these alloys and provided the nominal chemistry for DoE3.

DoE3

DoE3 studied the effect of Nb and Ti on strength, ductility and static crack growth resistance of these alloys based on the chemistry from DoE2, as well as another predetermined alloy chemistry. The base chemistry for DoE3 is shown in FIG. 15 for the fixed elements in weight percent. FIG. 16 shows the variable elements for DoE3 in weight percent and also for the hardener content, in at. %.

Heat 3Ca is the baseline chemistry showing maximum C content for the alloy. The hardener content was 4.39 at. %. In subsequent heats the amount of Ti was varied from 1.92 wt. % to 1.33 wt. % while the amount of Nb was varied from 3.47 wt. % to 4.07 wt. %. This resulted in hardener contents ranging from a high of 4.97 at. % to a low of 4.60 at. %. The variation in Ti+Nb was performed in such a way so as to keep the wt. % (Ti+Nb) constant at 5.40 wt. %.

The heat treatment given to Alloy C in DoE3 was as follows: 1) solution heat treatment at about 1650° F. for 1 hour, followed by; 2) fan cooling to ambient temperature, followed by; 3) reheating to a first precipitation aging heat treatment temperature of about 1350° F. for 8 hours, followed by; 4) furnace cooling at 100° F./hour to; 5) a second precipitation aging heat treatment temperature of about 1150° F. for 8 hours; and 6) subsequent still air cooling to ambient temperature.

The tensile mechanical behavior was measured at 75° F., 750° F. and 1150° F. Only the 75° F. and 750° F. tensile properties are shown in FIG. 17. FIGS. 5 and 6 show plots of 0.2% yield strength versus temperature (FIG. 5) and reduction in area (RA) versus temperature (FIG. 6) for DoE3 heats through 1150° F.

Based on the preferred chemistry of DoE3, variation in Ti and Nb produced only minor variations in strength and ductility for the solution and age heat treatment used. Static crack growth tests in air were then performed to evaluate the static crack growth resistance of the alloys. FIG. 19 shows the results of the static crack growth in the DoE3 heats compared to current gas turbine disk alloys, such as 706 two-step age.

Figure 18:
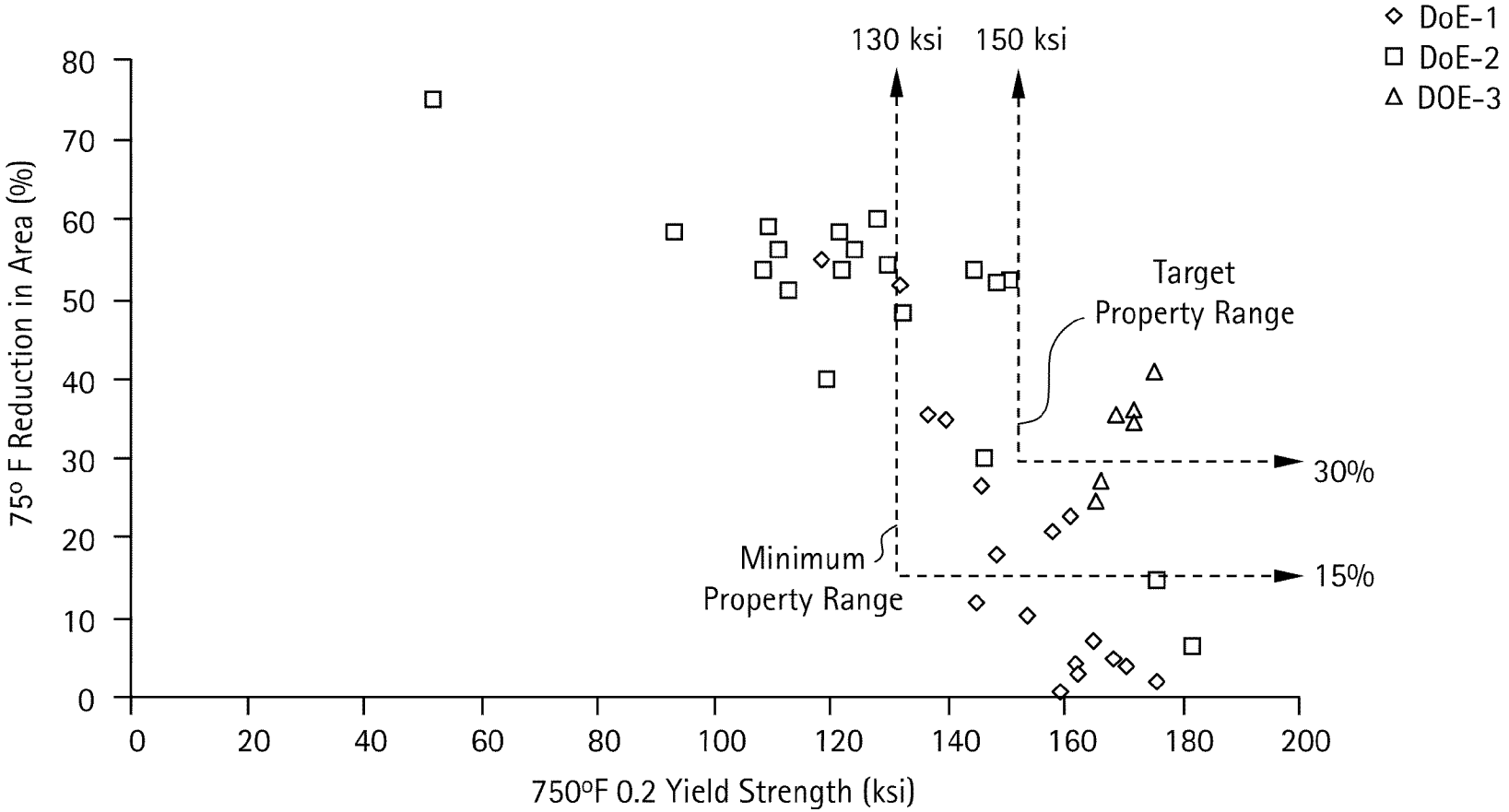
FIG. 18 is a plot of 0.2% YS at 750° F. versus RA at 75° F. as disclosed herein.
Figure 21:
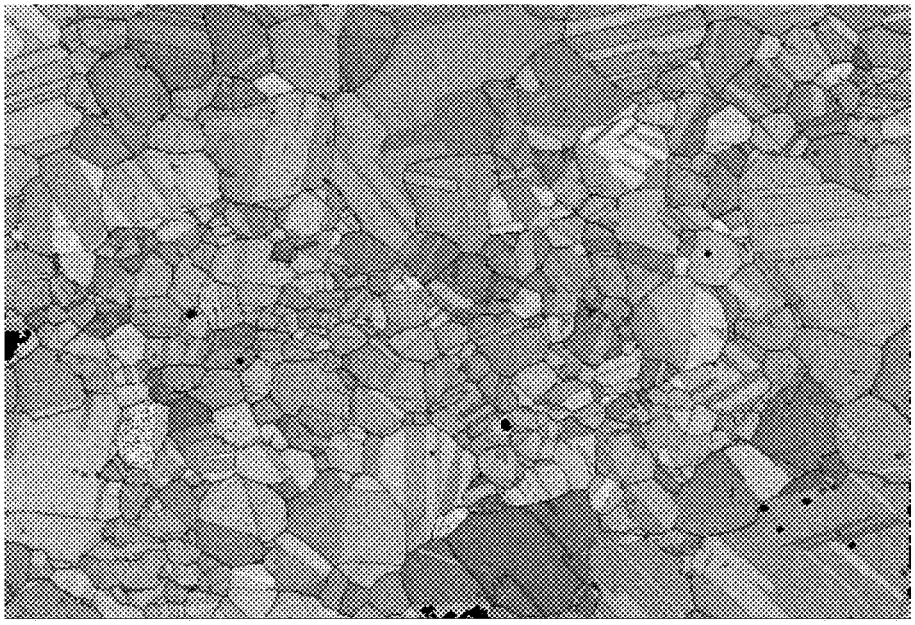
FIG. 21 is a photomicrograph of Heat 2Bl, heat treatment O as disclosed herein.
Figure 22:
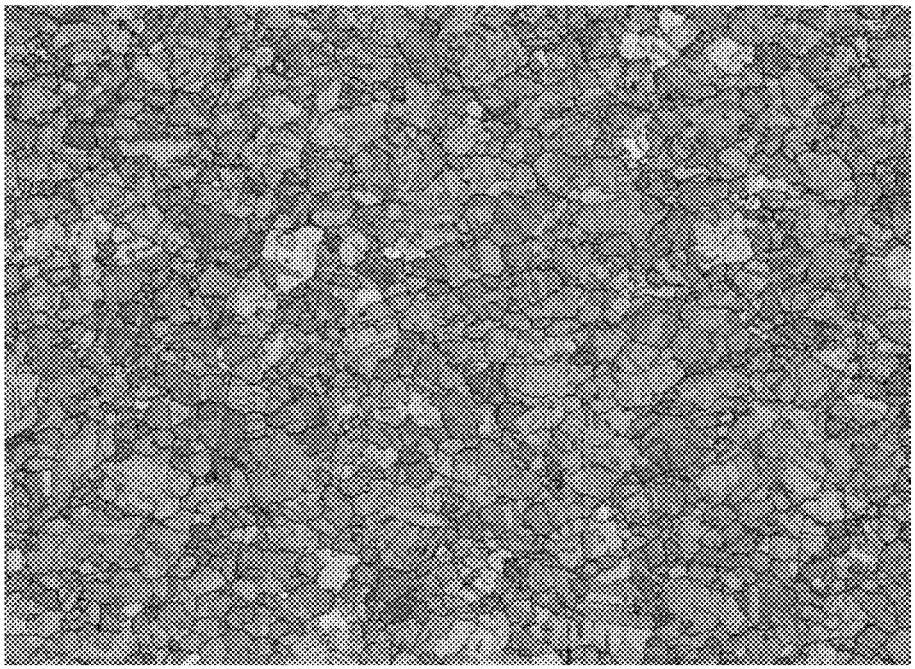
FIG. 22 is a photomicrograph of Heat 2Bl, heat treatment C as disclosed herein.

FIG. 18 shows the 75° F. RA versus 750° F. 0.2% YS for DoE1, DoE2 and DoE3 with a minimum property range and target property range indicated on the chart. From this chart four heats fall inside the target region—heats 3Ca, 3 Cc, 3Ce and 3Cf. It should be noted that only 3Cf failed before the end of the static crack growth testing at 1100° F. in air. Heats 3Cb and 3Cd were just marginally below the target RA value of 30%, with 3Cb having an RA value of 25% and 3Cd having an RA of 27%.

Given the results of DoE's 1-3, a solution and two-part aging heat treatment of the alloys described herein, including Alloy 725/Custom Age 625 PLUS and derivatives thereof, including a preferred range of chemical compositions thereof, provide increased ultimate tensile strength and 0.2% yield strength compared to conventional solution and aging heat treatments. In addition, the solution and aging heat treatments described herein result in static crack growth times to failure that are equal to, or better than, the best current Ni-base superalloy gas turbine disk alloy and disk alloy heat treatment for crack growth resistance, i.e., Alloy 706 3-step age. In addition to the crack growth resistance performance noted, the alloys described herein may be selected to provide higher strength, particularly yield strength than conventionally heat treated Alloy 725/Custom Age 625 PLUS. Additionally, the heat treatment of Alloy 725/Custom Age 625 PLUS and derivatives based therein, including a particularly useful chemical composition as described herein, result is higher strength alloys compared to Alloy 706 and the standard Alloy 725/Custom Age 625 PLUS.

A particularly useful alloy composition for gas turbine disks is shown in FIG. 20, although the solution and aging heat treatment specified herein would work for any alloy within the chemical composition ranges as described herein.

Detailed microstructure investigations were performed on selected alloys from DoE2. A portion of this work is shown in FIGS. 4, 23 and 24. Three cases are shown to illustrate differences in microstructure developed during the indicated heat treatment.

Case 1—Heat 2Bl-O. The test conditions were static loading, as described herein, with an initial stress intensity factor of K=28 ksi-(in)$^{1/2}$, at 1100° F. in steam. The solution heat treatment for this sample was 1800° F., or approximately 100° F. under the vendor recommended temperature of 1900° F. plus aging at 1350° F. for 8 hr followed by furnace cooling at 100° F./hr to 1150° F. for 8 hr followed by air cooling to ambient. Also, the first stage of the aging heat treatment was slightly elevated (by 50° F.) to increase yield and tensile strength. Solution heat treatment at this temperature resulted in a fully recrystallized microstructure with relatively large grains with extensive twinning. Not shown is an electron beam scattering diffraction (EBSD) analysis, which verifies that most of the boundaries have a low angle orientation between them (typically 3° or less). This is an indication of low residual strain in the matrix. Although tensile behavior is normal in terms of strength and ductility, the TTF in the static hold-time crack growth test is only 43 hours.

Case 2—Heat 2Bl-C. The test conditions: static loading, as described herein, with an initial stress intensity factor of K=28 ksi(in)$^{1/2}$, at 1100° F. in steam. In this example, the solution heat treatment temperature was lowered to 1750° F. plus aging at 1300° F. for 8 hr followed by furnace cooling at 100° F./hr to 1150° F. for 8 hr followed by air cooling to ambient. The aging heat treatment temperatures are at 1300° F. and 1150° F. as opposed to 1350° F. and 1150° F. as used in Case 1. The microstructure was again fully recrystallized but has a finer grain size. Extensive twinning is again observed. EBSD analysis again indicates a microstructure pretty much devoid of internal residual strain with low angle boundaries between grains (once again typically 3° or less), and much like Case 1. So a 50° F. difference in solution heat treatment temperature results in roughly the same general microstructure as Case 1 but with finer grains. TTF in the static hold-time was improved to 107 hours, probably as a result of the finer grain size, which increases the distance the crack must grow.

Case 3—Heat 2Bl-A. The test conditions: static loading, as described herein, with an initial stress intensity factor of K=28 ksi-(in)$^{1/2}$, 1100° F. in steam. The microstructure for the sample given a solution heat treatment at 1650° F. plus aging at 1300° F. for 8 hr followed by furnace cooling at 100° F./hr to 1150° F. for 8 hr followed by air cooling to ambient and shows a remarkably different microstructure than the other two cases. In this example, the microstructure is partially recrystallized with a mixture of smaller recrystallized grains interspersed between larger un-recrystallized grains, the remnant of the hot-worked microstructure. EBSD shows two important microstructural differences. First, the range of grain misorientations range to values greater than 10° and associated with this wide range of grain misorientation is increased residual strain. The combined effect of having a partially recrystallized microstructure with a range of grain misorientations with values of a few degrees to greater than 20° leads to a marked improvement in TTF in the static hold-time crack growth test, where sample does not fail in the predetermined testing timeframe. Analysis indicates an estimated TTF of >50,000 hours.

Thus, the Case 3 microstructures produced in the alloys and by the alloy heat treatments described herein offer significant improvement in static hold-time crack growth resistance and are a result of the partially recrystallized microstructure developed by the indicated heat treatment. Subsequent testing on the heats of DoE3, which used this heat treatment, confirmed the improvement in static hold-time crack growth resistance while at the same time developing a desirable 0.2% YS and ductility.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An NiCrMoNbTi superalloy article having a partially-recrystallized, warm-worked microstructure and comprising, in weight percent, about 55.0-63.0% Ni, about 19.0-22.5% Cr, about 6.5-9.5% Mo, about 2.75-4.5% Nb, about 1.0-2.3% Ti, up to about 0.35% Al, up to about 0.35% Mn, up to about 0.20% Si, up to about 0.010% S, up to about 0.20% C and up to about 0.015% P, with the balance Fe and incidental or trace impurities.

2. The article of claim 1, wherein the alloy composition further comprises, in weight percent: up to about 0.05 V, up to about 0.05 Ta, up to about 1.0 Co or up to about 0.02 B, or a combination thereof.

3. The article of claim 1, wherein C, Ti and Nb in any combination act as hardening constituents, and wherein, in weight percent, C is about 0.007 to about 0.011, Ti is about 1.33 to about 1.92, Nb is about 3.47 to about 4.07 and the total amount of Ti+Nb is about 4.99 to about 5.40, and the total amount of hardening constituents in atom percent is about 4.39 9 to about 4.97.

4. The article of claim 1, wherein the Ni-base superalloy has a 0.2% yield strength of at least about 187 ksi at about room temperature and at least about 165 ksi at about 750° C., an RA of at least about 24% at about room temperature and at least about 31% at about 1150° C. and a hold time crack resistance at 593° C. in air, a stress intensity factor of about 28 ksi-in½ with a load of about 1099 lbs. of at least about 2400 hours.

5. The article of claim 1, wherein the alloy composition comprises, by weight: about 59.0-63.0% Ni, about 19.0-22.5% Cr, about6.5-9.5% Mo, about 2.75-4.5% Nb, about 1.0-2.3% Ti, up to about 0.35% Al, up to about 0.20% Mn, up to about 0.20% Si, up to about 0.010% S, up to about 0.20% C and up to about 0.015% P, with the balance Fe and incidental or trace impurities; or about 55.0-59.0% Ni, about 19.0-22.5% Cr, about 6.5-9.5% Mo, about 2.75-4.5% Nb, about 1.0-2.3% Ti, up to about 0.35% Al, up to about 0.35% Mn, up to about 0.20% Si, up to about 0.010% S, up to about 0.03% C and up to about 0.015% P, with the balance Fe and incidental or trace impurities.

6. The article of claim 1, wherein the article comprises a turbine component, the turbine component comprising a blade, vane, rotor, stator, spacer, shroud, liner, nozzle, steam valve or combustor.

* * * * *